United States Patent [19]

Snyder

[11] 4,371,211

[45] Feb. 1, 1983

[54] TUNNEL BORING MACHINE AND METHOD OF OPERATING SAME

[75] Inventor: Larry L. Snyder, Twinsburg, Ohio

[73] Assignee: Jarva, Inc., Solon, Ohio

[21] Appl. No.: 215,221

[22] Filed: Dec. 11, 1980

[51] Int. Cl.[3] ..... E21D 9/10

[52] U.S. Cl. ..... 299/11; 299/31

[58] Field of Search ..... 299/11, 31

[56] References Cited

U.S. PATENT DOCUMENTS

| | | | |
|---|---|---|---|
| 3,383,138 | 5/1968 | Scaravilli et al. | 299/31 |
| 4,045,088 | 8/1977 | Bechem | 299/11 X |
| 4,189,186 | 2/1980 | Snyder | 299/31 |

FOREIGN PATENT DOCUMENTS

| | | | |
|---|---|---|---|
| 1279053 | 10/1968 | Fed. Rep. of Germany | 299/31 |
| 1758109 | 12/1970 | Fed. Rep. of Germany . | |
| 2826579 | 1/1980 | Fed. Rep. of Germany | 299/31 |

*Primary Examiner*—Ernest R. Purser

*Attorney, Agent, or Firm*—Pearne, Gordon, Sessions, McCoy & Granger

[57] ABSTRACT

A tunneling machine adapted to cut tunnels on a continuous basis and to apply continuous pressure on the tunnel face even during repositioning of the gripping legs is disclosed. The machine includes at least two supporting frames having a plurality of extendible feet which are adapted to grip the tunnel wall. The support frames are provided with axial bores therethrough, and a hollow piston extends through all of the bores for longitudinal movement along the axis of the tunnel. In accordance with the method, a tunneling operation is carried out by extending at least one pair of extendible feet against the walls of the tunnel to securely hold at least one of the support frames relative to the tunnel wall. The piston chamber of each support frame which is clamped to the wall is pressurized to drive the cutter head against the face of the tunnel. While the cutter head is being advanced in this manner, unclamped support feet are moved forward to a clamping position to take over when the first-mentioned support feet reach the end of their effective stroke. This operation is repeated to apply continuous thrust pressure to the cutting head.

7 Claims, 7 Drawing Figures

10
11
12
13
20
21
22
23
24
27
28
29
30
31
32
33
34
35
36
37
38
39
40
41
42
43
44
45
46
47
48
49
50
51
52
56
57
58
60
62
63
4
4

TUNNEL BORING MACHINE AND METHOD OF OPERATING SAME

BACKGROUND OF THE INVENTION

This invention relates generally to tunneling machines, and more particularly to tunneling machines having a rotary boring or cutting head for boring passages through soft rock, hard rock and minerals.

The digging of a tunnel through soft material, such as clay and soft rock, or only partially consolidated materials, has long been done by machines having a rotary cutting head having cutters which scrape and dig away at the material, which is then collected and removed rearwardly from the tunnel. However, when such machines are used against harder materials, and particularly very hard igneous and metamorphic rocks, such scraping-type cutters cannot be used, and it is necessary to employ rotary, percussive-type tools which chip away small fragments from the mass of rock by impact. The use of such cutters has long been known for drilling wells and other relatively small diameter holes, but efforts to adapt such cutters to larger machines for use in drilling tunnels have met with considerable difficulty because of the necessary forces involved and the shock loads encountered.

A reliable and proven machine has been developed for cutting hard rock at a fast enough cutting rate to make it competitive with prior drilling methods. That machine is set forth in U.S. Pat. No. 3,383,138. According to that patent, a fixed supporting frame is anchored in the tunnel by two axially spaced sets of projecting arms, each set of which has four arms equidistantly spaced and actuated by hydraulic cylinders to position the frame without regard to the weight of the machine. A movable frame is carried centrally within the supporting frame by sets of torque arms at each end, which both support the moving frame and transmit the reaction torque from the moving frame to the supporting frame. A cutter head is mounted in bearings at the front end of the moving frame and carries a cutter plate having a number of roller cutters mounted thereon. A drive shaft extends the length of the moving frame to project beyond the rear of the supporting frame where the shaft is driven by a plurality of motors which drive an encircling ring gear. Hydraulic cylinders acting between the supporting frame and the cutter head apply the force directly to the bearing supporting the cutter head to cause the moving frame to move relative to the supporting frame. After the moving frame is moved through its full range of movement, a jack is lowered at the rear end to support the moving frame by the jack and the cutter head to allow the supporting frame to have the arms retracted and moved forward to the next position, where the supporting frame is again anchored to allow the cutting movement to continue.

While such a tunneling machine can cut hard rock at a fast enough cutting rate to make it competitive with prior tunneling machines, contractors have demanded even faster cutting rates to minimize on-the-job dwell time and to meet contractual bidding demands. According to prior art practices, and as has been indicated above, a substantial portion of the available drilling time is expended in moving the gripping legs to an advanced position while the cutting head is idle at the tunnel face.

SUMMARY OF THE INVENTION

This invention provides a tunneling machine which is adapted to cut tunnels on a continuous basis and which is adapted to apply continuous pressure on the tunnel face even during repositioning of the gripping legs.

The tunneling machine according to this invention includes at least two supporting frames each having a plurality of extendible feet which are adapted to grip the tunnel wall. The support frames are provided with axial bores therethrough and a hollow piston extends through all of the bores for longitudinal movement along the axis of the tunnel. The piston is provided with piston heads for each of the hollow pistons which are slidable along the bores so that fluid pressure may be employed to advance the hollow piston. A drive shaft is rotatably mounted in the hollow piston and is fixed against longitudinal movement with respect to the piston. One end of the drive shaft carries a rotatable cutter head thereon, and the other end of the shaft is driven by a plurality of motors through a ring gear.

A tunneling operation is carried out by extending at least one pair of extendible feet against the walls of the tunnel to securely hold at least one of the support frames relative to the tunnel wall. The piston chamber of each support frame which is clamped to the wall is pressurized to push the cutter head against the face of the tunnel. While the cutter head is being advanced in this manner, the unclamped support feet are moved forward to a clamping position. As soon as the first-mentioned hollow piston nears the end of its stroke, the second-mentioned support frame is clamped in position to continue to push the cutter head, and the first-mentioned extendible feet are released so that its support frame may be repositioned for subsequent pushing action. Thus, the tunneling operation is continuous and there is no need to pause for the repositioning of support feet. To aid in supporting and steering the machine during the drilling operation, front and rear support feet are provided which are merely dragged along as the tunneling operation progresses.

DETAILED DESCRIPTION OF THE PREFERRED EMBODIMENTS

Figure 1:
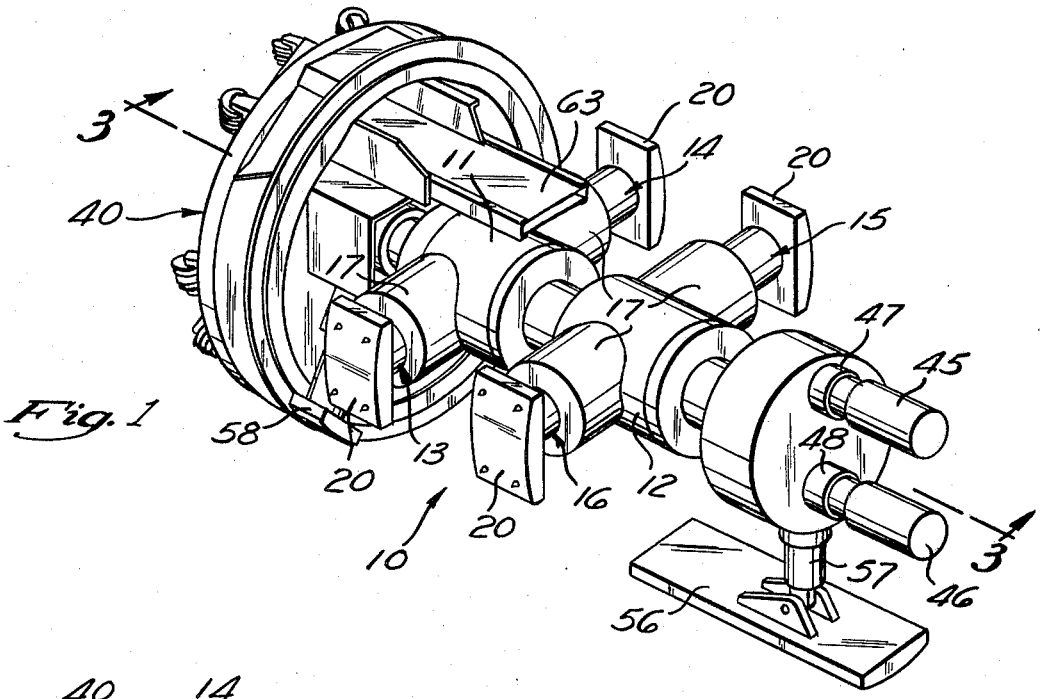
FIG. 1 is a perspective view of the tunneling machine.

Referring now to the drawings, there is illustrated a tunnel boring machine 10 having supporting frame members 11 and 12. Each support frame 11 and 12 is braced against the tunnel walls to position the machine in proper alignment and to absorb the torque and thrust forces produced by the cutting action. Each support frame 11 and 12 carries a pair of horizontal, radially extending clamp legs 13, 14, 15, and 16. Each leg 13–16 includes a saddle 17 having a piston bore 18 in which is mounted a piston 19, which may be pressurized by a suitable hydraulic source to drive the piston inwardly or outwardly. Each piston has a pressure pad 20 attached thereto by a ball 25 which is received in a spherical socket 26. The ball and socket connection between the pad 20 and its piston 19 permits movement of the pad relative to the piston to compensate for uneven tunnel wall portions. The foregoing arrangement provides a compact foot and provides an arrangement wherein fluid pressure is applied to a greater area of the pressure pad, as compared to prior art arrangements wherein pressure is applied to the pad by conventional piston and cylinder arrangements. The longitudinal axis of the support frames 11 and 12 may be guided and aligned for steering purposes by adjusting the relative radial extension of the pads by the pistons 19.

Figure 3:
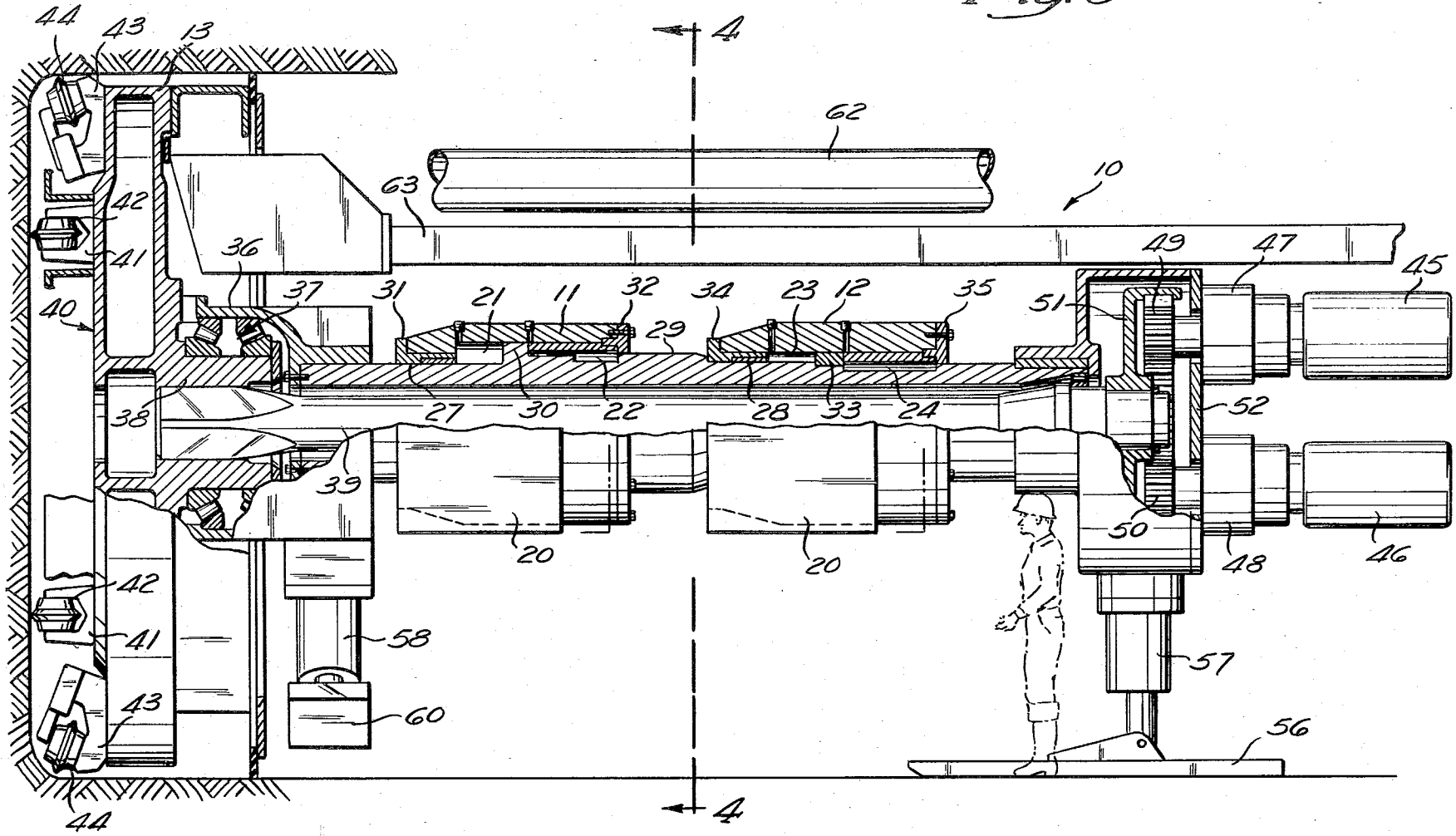
FIG. 3 is a cross sectional view, the plane of the section being indicated by the line 3—3 in FIG. 1.

Within bores 27 and 28 of the support frames 11 and 12, there is provided an elongated, hollow tube 29 which extends beyond the front and rear portions of the support frames 11 and 12. The hollow, elongated tube 29 has an annular piston head 30 adjacent its forward end which divides a space between the bore 27 and the elongated tube 29 into forward and rearward compression chambers 21 and 22, respectively. Those chambers are sealed at their outer ends by front and rear ring seals 31 and 32, respectively. The hollow tube 29 further includes a ring 33 which constitutes an annular piston head which divides a space between the bore 28 and the hollow tube 29 into forward and rearward pressure chambers 23 and 24, respectively. Those chambers are sealed at their outer ends by front and rear ring seals 34 and 35, respectively. As is illustrated in FIG. 3, the support frames 11 and 12 are both in a forward position with respect to the hollow tube.

The forward end of the hollow tube 29 carries an enlarged bell-shaped housing 36 which supports the outer race of a bearing 37. The bearing 37 is preferably of the high capacity, double-row, tapered roller-type adapted to absorb both radial loads and thrust loads in either direction. The split inner race of the bearing 37 is secured to the outer surface of a cutter head hub portion 38 of a drive shaft 39, which extends through the hollow tube 29 to journal the drive shaft for rotation with respect to the hollow piston.

A rotatable cutter head 40 is fixed to the forward end of the drive shaft 39 by a noncircular fit between the forward end of the drive shaft and the hub portion 38. As may be appreciated, keys may be used as an alternative. A plurality of inside saddles 41 are located in predetermined positions on the forward end face of the cutter head 40 by locating dowel pins (not shown) and are welded to the cutter head 40. Each inside saddle 41 carries an inside roller cutter 42. In a similar manner, a number of gauge saddles 43 are located in predetermined positions on the front face of the cutter head 40 by locating dowel pins (not shown) and suitably welded to the cutter head. A gauge roller cutter 44 is rotatably journaled in a suitable manner to each of the gauge saddles 43. The gauge saddles 43 support the gauge cutters 44 in such a manner that the axis of rotation of the gauge cutters 44 is at an angle to the axis of the rotation of the inside cutters 42, so that the tunnel end face is provided with a slightly relieved portion adjacent the cylindrical tunnel wall. A center cutter (not shown) is also provided. The details of the arrangement of the cutter head are conventional and are disclosed in more detail in U.S. Pat. No. 3,383,138, the disclosure of which is herein incorporated by reference.

The drive shaft 39 is rotated by electric drive motors 45 and 46 through gear reduction transmissions 47 and 48. The transmissions 47 and 48 are mounted on a housing 52 carried on the rear end of tube 29 and are provided with pinion gears 49 and 50 which mesh with and drive a ring gear 51 fixed to the rear end of drive shaft 39. It will be understood that this arrangement can use any number of drive motors, and these drive motors can be single or multiple-speed units if it is desired to vary the rotating speed of the cutting head. Likewise, the amount of reduction provided by the gear reduction transmissions is also selected to give the proper speed for the cutter head.

Figure 4:
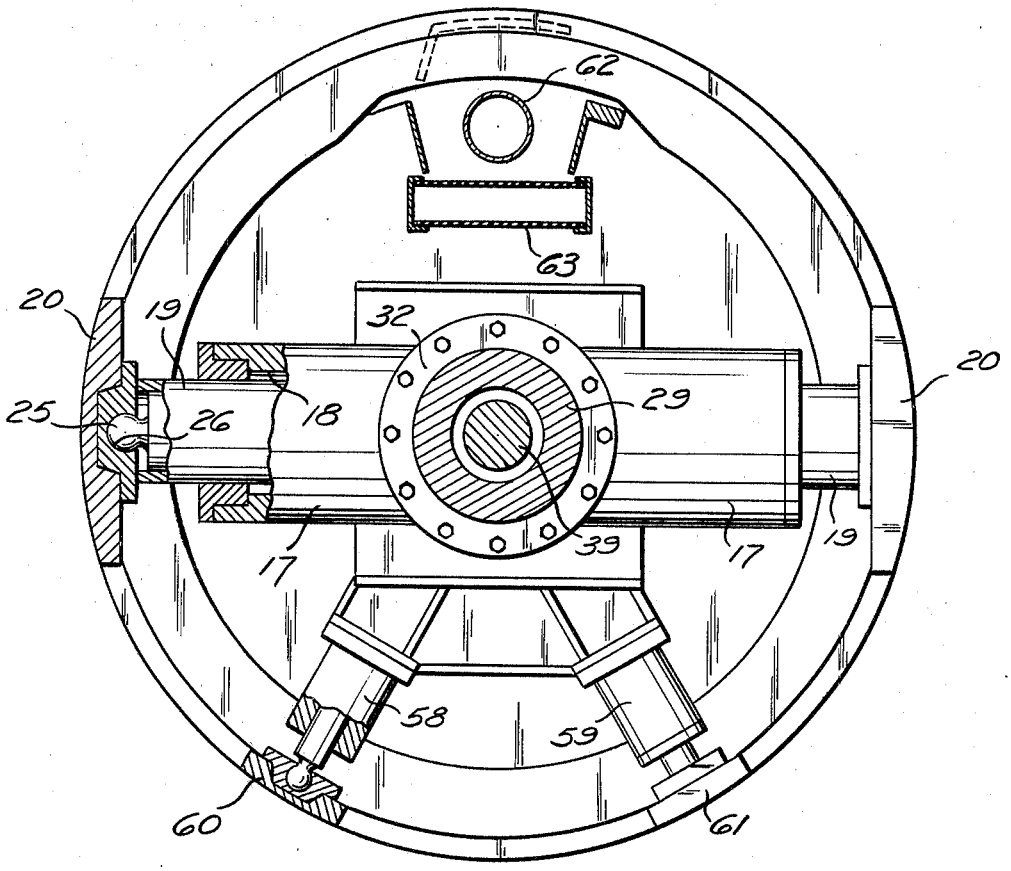
FIG. 4 is a cross sectional view, the plane of the section being indicated by the line 4—4 in FIG. 3.

Since, as will be described in greater detail hereinafter, the machine is supported during the cutting action at only one of the support frames 11 and 12, it is free to rotate about a transverse axis defined by the clamp legs on the particular support frame which is gripping the tunnel walls. For this reason, it is necessary to provide vertical support for the tunnel boring machine both in front of and behind the support frames 11 and 12. Accordingly, at the rear end of the machine beneath the rear housing 52 is mounted a vertically extending hydraulic cylinder 57 and a rear support foot 56 adapted to engage the bottom surface of the tunnel. At the front end of the machine, at the bearing housing 36, are mounted a pair of front cylinders 58 and 59, and their support feet 60 and 61, respectively. These front cylinders extend outwardly and downwardly at an angle (see FIG. 4), and can be used in unison to raise and lower the cutter head 40 and, by their selective alternative use, can be used to provide a certain amount of lateral tilting or shifting of the cutter head. In any case, it will be understood that all three of the support feet 56, 60, and 61 are extended against the tunnel wall surface and slide along it while the machine is progressing forwardly during cutting, and each of these feet will supply sufficient upward force for the machine to keep it in proper alignment in the tunnel.

The cyclic operation of the machine, which allows it to maintain a continuous forward cutting action, is best shown in connection with the schematic views of FIG. 2. As shown at FIG. 2A, the rear support frame 12 has its clamp legs 15 and 16 retracted, and is at a rearward position on the hollow tube 29 and is therefore inactive. The front support frame 11 has its clamp legs 13 and 14 extended into gripping contact with the tunnel walls, and its rearward chamber 22 is therefore pressurized while its forward chamber 21 is allowed to drain to reservoir. The pressure within the rearward chamber 22 causes a forward thrust to push the cutter head 40, which is being continually rotated by the drive motors 45, forwardly against the end face of the tunnel so that the rock can be broken away in the well known manner.

Figure 2A:
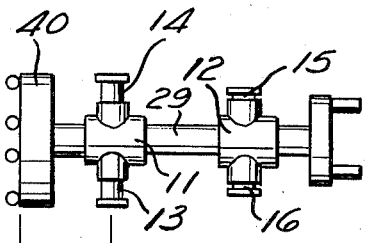
FIGS. 2A, 2B, 2C, and 2D are sequential schematic views showing the progression of the machine and the relative positions of its parts as a tunnel is dug.
Figure 2B:
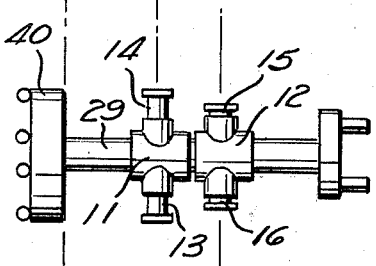

While the machine is moving forward and as tube 29 slides forwardly with respect to the front support frame 11, the position of the rear support frame 12 is advanced along forwardly with respect to the hollow tube 29 by pressurizing the forward chamber 23 of rear support frame 12 until that frame moves to the position shown in FIG. 2B, which also shows the hollow tube 29 at the forward position with respect to the front support frame 11. Just before the hollow tube 29 reaches the end of its forward stroke with respect to the front support frame 11, the clamp legs 15 and 16 of the rear support frame, now in the position shown in FIG. 2B, are extended so that for a short period of time all four of the clamp legs 13–16 are in gripping contact with the sidewalls of the tunnel. At this time, both of the rearward chambers 22 and 24 will be pressurized simultaneously for a short period of time, and since this doubles the effective area, constant forward cutting force is maintained by reducing the pressure in both of these chambers to half the level that is used when only a single chamber is used to provide the forward thrust.

Figure 2C:
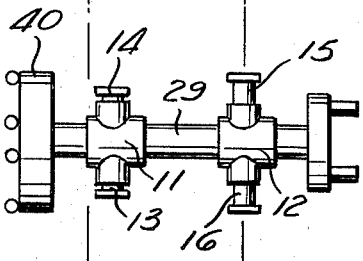
Figure 2D:
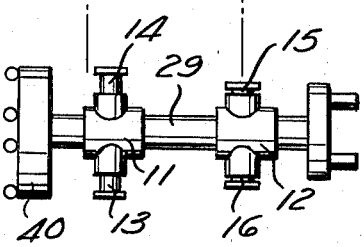

After this brief period of time, when both legs are clamped, the front clamp legs 13 and 14 are withdrawn when the hollow tube 29 has reached the forward end of its stroke with respect to the front support frame 11. However, the cutting continues without hesitation because of the pressurization of the rearward chamber 24 and the clamping at the rear support frame 12 now provides the forward thrust. After the front clamp legs 13 and 14 are retracted, the forward chamber 21 on front support frame 11 is then pressurized to cause the front support frame 11 to move forwardly along tube 29 until it reaches the front position as shown in FIG. 2C. Again, at a point of time when the hollow tube 29 has reached the forward end of its stroke with respect to the rear support frame 12, the front clamp legs 13 and 14 are extended so that for a short period of time all four clamp legs are again engaging the sidewalls of the tunnel, and during this time the thrust pressure is again reduced in half to maintain the same total forward thrust. Thus at this point, while the front clamp legs 13 and 14 maintain their gripping force, the rearward clamp legs 15 and 16 are withdrawn, as shown in FIG. 2D, which completes the cutting cycle.

With this arrangement, the forward movement of the cutter head 40 is truly continuous and without hesitation, even during the transfer of the gripping from the one support frame to the other, because of the short period of overlap in which both support frames are in gripping contact with the tunnel and provide a forward thrust. While the machine is operating with only a single support frame in gripping contact with the tunnel, the other support frame is advanced forward along the hollow tube 29 to be in a more forward position to again take over the gripping of the tunnel walls and provide a forward thrust when the other support frame nears the end of its stroke.

It will be understood that otherwise the operation of the machine is conventional and the cutter head is provided with all the usual accessories, such as scrapers and mud buckets for removing the debris and transferring them to a conveyor shown at 63, passing rearwardly over the top of the machine to the auxiliary equipment behind the tunneling machine. Likewise, it is possible to provide the usual ventilation line 62 for bringing in fresh air to the front of the machine, and the necessary operator's console (not shown) can be provided adjacent the rear housing 52 out of the way of the two moving support frames 11 and 12.

While the machine has been shown as a hard rock boring machine, it is recognized that it may also be outfitted with a shield surrounding the machine rearwardly of the cutter head 40, with suitable openings for the front support feet 60 and 61, as well as the pressure pads 20 on the clamp legs 13–16. Such a shield may be advanced by suitable means, such as hydraulic cylinders, to follow along behind the cutter head 40, but it is recognized that under those circumstances it may be necessary to temporarily stop the forward motion of the cutter head 40 to allow the thrust cylinders for the shield to be repositioned to continue their forward movement. However, such pauses or hesitations would be much shorter than otherwise, since it is only necessary to reposition the shield advancing mechanism and not the clamping legs themselves, and such pauses for repositioning the shield drive mechanism can be done at any point during the cutting cycle as set forth hereinabove.

While the preferred embodiment uses internal annular hydraulic pressure chambers on the hollow tube 29 and front and rear support frames 11 and 12, this arrangement is best suited for machines for boring relatively small diameter tunnels. When the invention is applied to larger machines, it is recognized that external thrust cylinders may be employed with suitable mounting arrangements to act between each of the support frames and the frame carrying the rotating cutting head. Furthermore, each of the support frames may use more than two clamp legs located at peripherally spaced positions or axially spaced positions with respect to each of the support frames.

While a preferred embodiment of this invention has been shown and described, it should be understood that various modifications and rearrangements of the parts may be resorted to without departing from the scope of the invention as disclosed and claimed herein.

What is claimed is:

1. A tunneling machine comprising a plurality of support frame means, holding means on each support frame means outwardly movable to grip a tunnel wall to fixedly position their associated support frame means in the tunnel, each of said support frame means having a bore therethrough, an elongated, hollow tube extending through each bore and having an annular piston positioned in each bore, said pistons and bores constituting fluid pressure chambers to cause relative movement between said hollow tube and said support frame means, drive shaft means rotatably mounted in said hollow shaft and being fixed against longitudinal movement with respect to said piston, one end of said drive shaft means extending beyond said plurality of support frame means and driving a rotatable cutter head, and rotatable driving means at the other end of said drive shaft means, each of first ones of said support frame means including hydraulic means having a pressure mode to force its said holding means against the tunnel wall while supplying fluid to its fluid pressure chamber which drives the rotary cutter head against the tunnel face, each of second ones of said support means including hydraulic means adapted to retract its said holding means from the tunnel wall while exhausting fluid from its pressure chamber to move said second ones of said support means along the hollow tube toward the cutter head while said first ones of said support means are in their pressure mode.

2. A tunneling machine as set forth in claim 1, wherein said holding means comprise a plurality of radially extendible feet extending horizontally from said support frame.

3. A tunneling machine as set forth in claim 2, wherein said holding means comprise two front feet and two rear feet and wherein each foot is a cylinder having an expansible piston therein.

4. A tunneling machine according to claim 1, including a plurality of extendible support feet fixed to the rearward and forward ends of said machine to support and steer the machine during a tunneling operation.

5. A tunneling machine comprising a pair of support frames, each of said support frames having a pair of radially extending feet extending horizontally from said support frame and adapted to grip a tunnel wall to fixedly position their associated support frames in the tunnel, each of said support frames having a bore therethrough, an elongated tube extending through each bore and having an annular piston positioned in each bore, said pistons and bores constituting fluid pressure chambers to cause relative movement between said hollow tube and said support frames, drive shaft means rotatably mounted in said hollow shaft and being fixed against longitudinal movement with respect to said hollow tubes, one end of said drive shaft extending beyond the support frames and driving a rotatable cutter head, and rotatable driving means at the other end of said drive shaft, a first one of said support frames including hydraulic means having a pressure mode to force its holding means against the tunnel wall while supplying fluid to its fluid pressure chamber which drives the rotary cutter head against the tunnel face, a second support frame including hydraulic means adapted to retract its support feet from the tunnel wall while exhausting fluid from its pressure chamber to move said second support frame along the hollow tube toward the cutter head while the first support frame is in its pressure mode.

6. A tunneling machine according to claim 5, including a plurality of extendible support feet fixed to the rearward and forward ends of said tunneling machine to support and steer the machine as the tunneling operation progresses.

7. The method of advancing a tunneling machine along a tunnel bore, said tunneling machine having a main frame supporting a cutter head rotatable about an axis parallel to the tunnel axis and a pair of support frames each adapted to independently and selectively grip the tunnel wall and mounted for movement along the tunnel axis independently of the main frame and each other, comprising the steps of:

(1) causing one support frame to grip the tunnel wall while applying thrust between said one support frame and said main frame, (2) after said cutter head has advanced a given distance causing said other support frame to grip the tunnel wall and applying thrust between said other support frame and said main frame, (3) thereafter releasing said one support frame from the tunnel wall and advancing it along said main frame towards said cutter head, (4) after said cutter head has advanced a given distance causing said one support frame to grip the tunnel wall and applying thrust between said one support frame and said main frame, (5) reducing the thrust between each support frame and the main frame in half when thrust is applied between both support frames and said main frame simultaneously, whereby the thrust of said cutter head along said tunnel axis remains substantially constant through steps (1) through (6), and (6) thereafter releasing said other support frame from the tunnel wall and advancing it along said main frame towards said cutter head, whereby said cutter head is continuously advanced along the tunnel axis during steps (1) through (6).

* * * * *